United States Patent [19]

Friday

[11] Patent Number: 4,949,740

[45] Date of Patent: Aug. 21, 1990

[54] WHEELCHAIR RAINWARE

[76] Inventor: Barry J. Friday, 909 E. Upsal St., Philadelphia, Pa. 19150

[21] Appl. No.: 360,115

[22] Filed: Jun. 1, 1989

[51] Int. Cl.[5] ..... A61G 5/10

[52] U.S. Cl. ..... 135/90; 280/304.1; 296/78.1; 135/117; 135/106

[58] Field of Search ..... 135/88, 90, 101, 106, 135/117, 119, 115; 280/304.1; 296/77.1, 78.1, 83

[56] References Cited

U.S. PATENT DOCUMENTS

| | | | |
|---|---|---|---|
| 247,424 | 9/1881 | Shoeninger | 135/88 |
| 3,243,230 | 3/1966 | Otto | 135/90 |
| 4,389,057 | 6/1983 | Richard, Jr. | 280/304.1 |
| 4,533,170 | 8/1985 | Banks et al. | 135/88 |
| 4,593,929 | 6/1986 | Williams | 296/77.1 |

FOREIGN PATENT DOCUMENTS

| | | | |
|---|---|---|---|
| 2168018 | 6/1986 | United Kingdom | 280/304.1 |

*Primary Examiner*—Carl D. Friedman
*Assistant Examiner*—Caroline D. Dennison
*Attorney, Agent, or Firm*—Susan Borden Evans

[57] ABSTRACT

This invention provides an inclement weather protective hood device against weather conditions for wheelchair occupants. The device comprises a symmetrical collapsible tubular detachable structure covered by a two toned transparent plastic covering, clear in front and sides, and tinted top and back. The two toned covering will permit chair occupant to have good visibility and to be seen more easily by pedestrian and vehicular traffic.

11 Claims, 1 Drawing Sheet

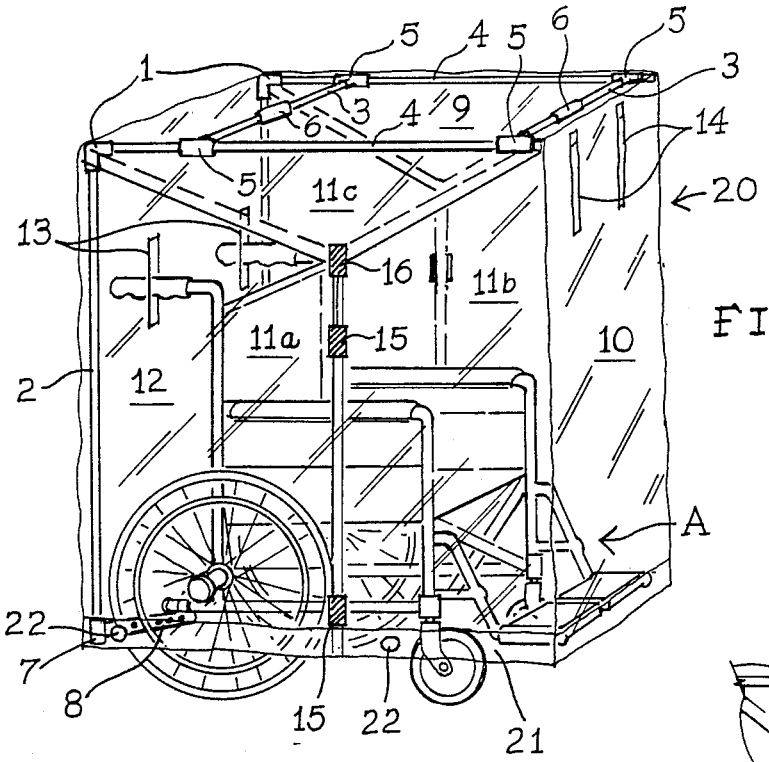
FIG. 1
FIG. 4
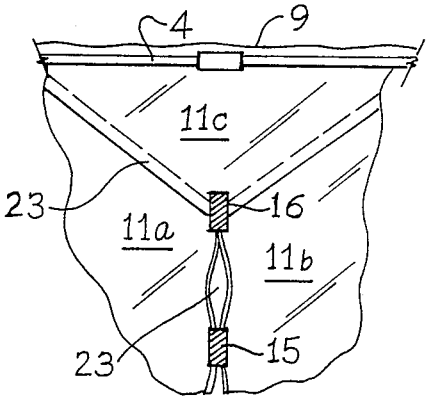
FIG. 2
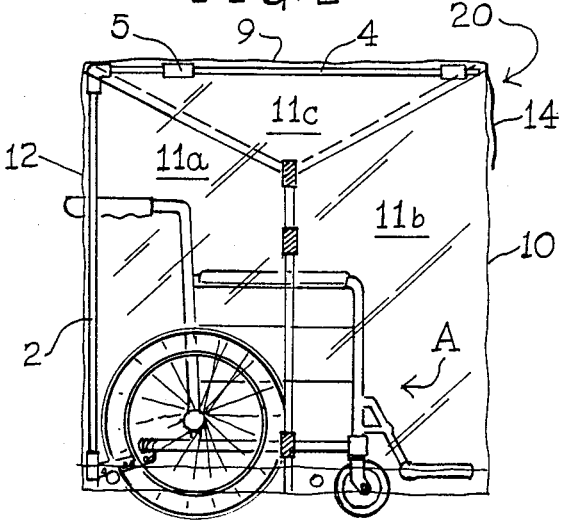
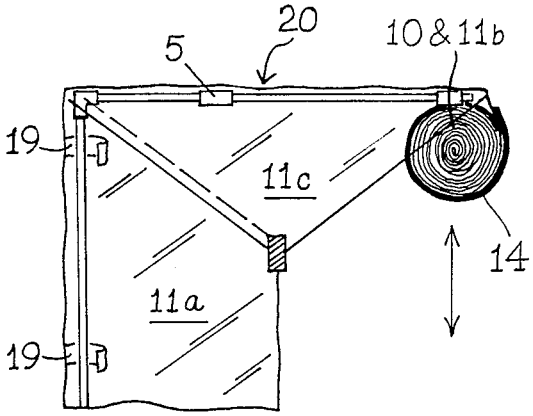
FIG. 5
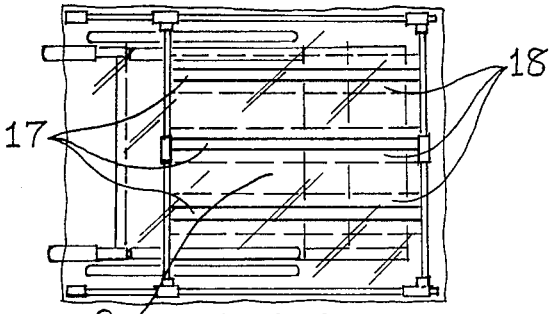
FIG. 3

WHEELCHAIR RAINWARE

BACKGROUND OF THE INVENTION

This invention relates to a protective hood device for a conventional wheelchair and particularly to an inclement weather protective device attached to a conventional wheelchair.

In the past several years the Federal Government has been more cognizant of the needs of handicapped people and has acted on those needs by passing laws requiring communities to redesign public buildings, streets and other facilities in order to aid handicapped persons. This has enabled more and more handicapped people, especially those in wheelchairs, to become more self sufficient being able to live relatively normal lives by being able to hold regular jobs in the market place and to travel throughout the community without much assistance. The wheelchair occupants can now safely cross the street from one sidewalk to the other because of depressions in the curbs; they can use public transportation such as buses because of the requirement that buses have lowering devices to assist the wheelchair occupant on and off the bus; public buildings now have ramps for unassisted access and public bathrooms are set up to accommodate the wheelchair occupant. With the advent of these changes in the communities, a very significant and valuable resource of the community has been tapped benefiting the community overwhelmingly while building self-worth, confidence, and esteem in handicapped people. With this mobilization of the wheelchair occupant also came the problem of protection against the inclement elements such as rain, hail or snow.

Prior to the present invention, the wheelchair occupants had been subject to severe weather conditions without adequate means for protection against them in their daily excursions. Conventional wheelchairs do not come equipped with adequate protection against inclement weather conditions. Therefore, a need exists for a device for use with a conventional wheelchair to protect the occupant from inclement weather conditions. This need has been satisfied with the present invention.

SUMMARY OF THE INVENTION

This invention is directed to an inclement weather protective hood device for use with a wheelchair constructed of a collapsible support frame for attachment to the undercarriage of the wheelchair and a removable transparent plastic covering supported by said frame for protecting the wheelchair and occupant against inclement weather conditions, said collapsible support frame comprising a rectangular shaped portion of four tubular members joined at two front corners thereof by hinge joint connectors and at two rear corners by hinge joint connectors where the rectangular shaped portion is supported over the wheelchair at a sufficient distance above the wheelchair to accommodate a seated occupant by a pair of vertical tubular members attached at the top ends by privotable hinge joint connectors to the rectangular portion and attached at the other ends to the undercarriage of the wheelchair by undercarriage connector means, said transparent removable plastic covering comprising a top, a front, a rear, and two side panels that are joined together at their edges to form an enclosure that is supported by said support frame where the side panels and front panel are designed so that a portion of the side panels can be opened and rolled up with the front panel and locked in a rolled up position for visibility and access to and from the wheelchair by the occupant.

BRIEF DESCRIPTION OF THE DRAWINGS

These as well as other features of the present invention will become more a rent upon reference to the drawings wherein:

FIG. 1 is a perspective view of the inclement weather protective hood device attached to a wheelchair as used in the invention;

FIG. 2 is a side view of the inclement weather protective hood device attach to the wheelchair as used in the invention;

FIG. 3 is a top view of the inclement weather protective hood device of the invention;

FIG. 4 is an isolated side view of portions of the side panels joined together by a securing device of the inclement weather protective hood device of the invention; and FIG. 5 is an isolated side view of the front panel and portions of the side panels in the rolled-up position of the invention.

DETAILED DESCRIPTION OF THE INVENTION

Referring to FIG. 1, collapsible support frame comprises a rectangular shaped portion, to support the canopy portion of the covering, of two horizontal tubular members 4 and two transverse tubular members 3. Each of the tubular members 3 has a folding hinge joint 6 mid-way between the member. At a position of each of the members 3 and 4, they are joined together by connecting hinge joints 5. Folding hinge joints 1 connect horizontal tubular members 4 to vertical tubular members 2 that are attached to undercarriage attachment mechanism 8 by joint 7. The hinge joints 1,5, and 6 of the protective hood device 20 are easily manipulated so that the tubular members of the frame can easily be detached from the wheelchair and rotated through 270 degrees for making into a compact unit. The hinge joints 1 are first rotated 270 degrees bringing canopy and frame portion parallel with tubular members 2; The vertical tubular members 2 are then disconnected from the wheelchair A and hinge joints 6 are rotated inwardly to bring the left side of the canopy and frame portion to be adjacent to the right side of the canopy and frame portion. The vertical tubular members 2 can optionally then be adjusted to the same length as the members 4 (when needed) for securing in a storage container which fits on the rear of the wheelchair.

FIG. 2 shows a side view of the protective hood covering which is composed of a top panel 9, a rear panel 12, a front panel 10, and left and right side panels having portions 11*a*, 11*b* and 11*c*. The left and right side panel portions 11*b* can be folded inwardly against front panel and the front panel 10 and left and right side panel portions 11*b* can be rolled up and locked into place with tabs 14 (see FIG. 1). FIG. 5 shows the device 20 with the left and right side panel portions 11*b* and front panel 10 rolled up and locked with tabs 14 in the up position for providing easy access in and out of the wheelchair.

FIG. 4 shows that side panel portions 11*c* are triangular in shape and extend over upper edge of portions 11*a* and 11*b* of common overlapping sides. Triangular portions 11*c* are connected to top panel 9 and drape over the side of the frame and are attached to 11a and 11b in only on place by attachment means 16. The reason that 11c is only attached to 11a and 11b at the apex via 16 is that 11c portions provide venting against updrafts through their opening 23; this is a safety measure that prevents a parachute effect or strong wind from turning the device over. Side panel portions 11a and 11b attach to each other by attachment means 15. Said attachment means 15 and 16 can be in the form of snaps, magnets, adhesive or Velcro tabs attachments. The triangular portions 11c can readily be completely opened by a very strong wind thus releasing the attachment means 16, so that the triangular portions 11c hang freely allowing for easy accessibility and venting.

The front panel 10 and side panel portions 11b and 11c are made of clear plastic material; the top panel 9, rear panel 12 and side panel portions 11a are transparently tinted which make the device noticable by traffic and provide protection from sunlight. The clear panels allow the chair occupant to have good visibility and provide greater viewability for pedestrians and vehicular traffic. Slits 13 are in the rear panel 12 so that the handles of the wheelchair can be accessed for assisting the wheelchair occupant.

The tubular members of the collapsible support frame are made out of light-weight material such as a rigid plastic, wood, reeds, or metals (e.g. aluminum, tin, chrome, steel).

FIG. 3 shows the top panel 9 of the covering with extra rigid rod supports 17 therein that fit into pockets 18 in panel 9 that will help to prevent water reservoirs puddling on the top panel 9.

The protective hood device 20 is preferably formed of a material such as a transparent vinyl plastic material for the front panel 10 and side panel portions 11b and tinted transparent vinyl plastic material for the top panel 9, rear panel 12 and side panel portions 11a. The tinted panels provide good visibility by the traffic and shield the wheelchair occupant from direct rays of sunlight on very sunny days; the clear transparent panels provide good viewability of the occupant. Where the side panel portions 11a and 11b join together by securing device 15, there are openings between said device 15 to provide additional venting means in order to prevent up drafts under windy conditions. Also, these vents provide arms access for the wheelchair occupants so that he may communicate directly therethrough; the vents also maintains comfortable climate conditions within the hood 20.

The plastic covering is secured to the frame by passageways at the corners 19 in the form of loops, tab connectors or the like (loops are shown in FIG. 5) wherein the front members are passed therethrough. In this manner the plastic covering and frame members become a unitary device. The frame members can easily be disassembled from the covering by merely sliding the tubular member out of the passageways that would be well known to a person in this art.

The different panels of the covering can be sewn together in an overlapping seam or fused together either by hot fuse or by cold fuse with a glue or adhesive, or the like. At the bottom of the side panel portions 11a and 11b, a wide double plastic thickness seam 21 can be used and a grommet 22 can be included therein for anchoring means of these panels to the wheelchair.

What I claim is:

1. An inclement weather protective hood device for use with a wheelchair constructed of a collapsible support frame for attachment to the undercarriage of the wheelchair and a removable transparent plastic covering supported by said frame for protecting the wheelchair and occupant against inclement weather conditions, said collapsible support frame comprising a rectangular shaped portion of four tubular members joined at two front corners thereof by hinge joint connectors and at two rear corners by hinge joint connectors where the rectangular shaped portion is supported over the wheelchair at a sufficient distance above the wheelchair to accommodate a seated occupant, said collapsible support frame further comprising a plurality of tubular supports comprising a symmetrical construction with a pair of parallel vertical tubular members attached to undercarriage attachment mechanism in the base of the wheelchair seat, and said vertical tubular members interconnecting with a pair of parallel horizontal tubular members at a height above the wheelchair occupant's head and which extend forward the length of the wheelchair and a pair of parallel transverse tubular members which transverse the rear and front of the structure, said transverse tubular members attaching to the horizontal tubular members recessed in from the rear and front at a distance of not less than about 1 inch, and a plurality of tubular members where the vertical tubular members connect with the horizontal tubular members at the uppermost rear point, and on the transverse tubular members midway between the members and at the interconnection between the horizontal tabular members and the transverse tubular members, and said removable transparent plastic covering comprising top, front, side, and rear panels and wherein the side panels are comprised of forward, rear and triangular portions, which covering is attached to the tubular support members by passageways at the corners, with the front panel and forward portions of the side panels provided with means to secure in a rolled up position, wherein the top panel is comprised of a transparent or translucent flexible material with 3 or more equidistant rod pockets traversing the length of the structure, said rod pockets housing lightweight rods for support and to reduce the reservoir capacity of the top panel and further the two triangular portions of the side panels are attached at the edges of the top panel and extend downwardly over the top of the other side panel portions and have means to attach to the other portions of the side panels by a quick release mechanism at the apex of the triangular portion allowing for easy accessibility and venting, wherein the tubular support and covering device can be easily removed, folded and stored in a container which is provided for storage and transport.

2. The device of claim 1, wherein the removable flexible plastic covering is a two toned plastic, with transparent front and sides and tinted transparent top, back and rear side panels to provide chair occupant with good visibility and provide greater viewability for pedestrian and vehicular traffic as well as provide some protection from the sunlight.

3. A device of claim 2 wherein the plastic covering contains as integral elements thereof air vents to prevent sudden up-drafts.

4. A device of claim 3 wherein the quick release mechanism is selected from snaps, magnets, adhesive, and Velcro tabs.

5. The device of claim 4 wherein the lightweight rods are selected from plastic, wood, reeds and metal.

6. The device of claim 5 wherein the vertical tubular members can be adjusted within themselves through telescopic construction.

7. The device of claim 6 wherein the hinge mechanisms situated at the interconnection between the vertical tubular members and horizontal tubular members are left and right hinges designed to rotate up to 270 degrees so when rotated downwardly the horizontal tubular members and the vertical tubular members become adjacently situated in a parallel compact unit.

8. The device of claim 7 wherein the quick release mechanisms are comprised of velcro and the tubular members are lightweight metal rods.

9. The device of claim 8 wherein the passageways secure the plastic covering to the frame at the corners by loops or tab connectors.

10. The device of claim 9 wherein the different panels of the covering can be sewn together in an over lapping seam or fused together either by hot fuse or by cold fuse or with a glue or adhesive.

11. The device of claim 10 wherein a grommet is use as anchoring means at a seam at the bottom of the side panels.

* * * * *